US005092128A

United States Patent [19]

Shekleton

[11] Patent Number: 5,092,128

[45] Date of Patent: Mar. 3, 1992

[54] STORED ENERGY COMBUSTOR

[75] Inventor: Jack R. Shekleton, San Diego, Calif.

[73] Assignee: Sundstrand Corporation, Rockford, Ill.

[21] Appl. No.: 455,497

[22] Filed: Dec. 22, 1989

[51] Int. Cl.[5] ..... F02C 1/00

[52] U.S. Cl. ..... 60/746; 60/760

[58] Field of Search ..... 60/39.12, 39.141, 39.142, 60/39.821, 39.827, 722, 733, 743, 746, 748, 752, 760; 431/254, 258, 260, 263, 264, 265, 266

[56] References Cited

U.S. PATENT DOCUMENTS

| | | | |
|---|---|---|---|
| 1,828,784 | 10/1931 | Perrin | 60/39.59 |
| 2,706,150 | 4/1955 | Lloyd | 60/746 |
| 2,918,118 | 12/1959 | Schirmer . | |
| 3,691,762 | 9/1972 | Ryberg et al. | 60/746 |
| 3,973,390 | 8/1976 | Jeroszko | 60/743 |
| 4,343,148 | 8/1982 | Shekleton | 60/748 |
| 4,404,806 | 9/1983 | Bell, III et al. | 60/743 |

*Primary Examiner*—Richard A. Bertsch
*Assistant Examiner*—Timothy S. Thorpe
*Attorney, Agent, or Firm*—Wood, Phillips, Mason, Recktenwald & VanSanten

[57] ABSTRACT

In order to significantly reduce the carbon produced in a combustor (10), and thus reduce or eliminate carbon buildup on combustor walls (14), a stored energy combustor (10) has a fuel discharge port (30) downstream of the combustion chamber (20). The downstream fuel discharge port (30) directs fuel into a secondary stored energy zone (24) downstream of a primary stored energy zone (22) comprised of an inlet end (16) and the combustion chamber (20) which receives an oxidant and a fuel through an upstream fuel discharge port (28) where the oxidant/fuel mixture is ignited to produce hot gases of combustion. The downstream fuel discharge port (30) is arranged to direct fuel in a manner forming a fuel film on the interior wall (14) in the secondary stored energy zone (24) such that the hot gases of combustion interact with the fuel film to cause fuel evaporation by establishing a stratified fuel annulus (54, 56). In particular, the stored energy combustor (10) is such that the hot gases of combustion interact with a cold liquid fuel film (54) on the interior wall (14) to cause fuel evaporation in the secondary stored energy zone (24) while also producing a cool gaseous fuel annulus (56) thereabout adjacent the interior wall (14) from evaporation of the cold liquid fuel film (54).

27 Claims, 1 Drawing Sheet

10
12
14
16
18
20
22
24
26
28
30
30'
32
34
36
38
40
42
44
44'
46
48
50
52
54
56
3

STORED ENERGY COMBUSTOR

FIELD OF THE INVENTION

The present invention is directed to a stored energy combustor and, more particularly, a stored energy combustor utilizing wall fuel film evaporation.

BACKGROUND OF THE INVENTION

Stored energy combustors have long been utilized for producing hot gases under pressure to operate turbine engines. In such stored energy combustors, a carbonaceous fuel is typically combusted with an oxidant to produce hot gases of combustion, and additional fuel may typically be introduced into the hot gases of combustion to be vaporized, or partly decomposed, or both. By so doing, the volume of hot gas can be increased while bringing the temperature of the combustion gas down to a temperature incapable of causing damage to the turbine engine.

One difficulty in the operation and use of such stored energy combustors is carbon buildup which results when the fuel is not completely oxidized and elemental carbon is formed within or downstream of the combustion chamber. It is important to keep the internal walls of the stored energy combustor free of carbon buildup since such carbon can break away and cause damage to downstream components and can also impair the efficiency of the combustor and turbine engine. To this end, carbon buildup can be avoided by providing an excess of oxidant within the combustion chamber but this necessarily results in excessive consumption of oxidant during operation of the stored energy combustor.

On the other hand, there is ordinarily a plentiful supply of liquid fuel in most cases. It has thus been conventional practice to run stored energy combustors on the rich side so that all available oxidant is consumed during combustion to thereby minimize oxidant consumption. However, by so doing, the potential for carbon buildup is increased.

As pointed out in Perrin U.S. Pat. No. 1,828,784, issued Oct. 27, 1931, it is also desirable to cool the combustion chamber to prevent damage thereto by excessive heat from combustion occurring therein. Advantageously, this is accomplished by cooling the combustion chamber with fuel, but the fuel may get overly hot causing gumming up leading to rapid failure and, furthermore, the fuel starts to boil which makes fuel injector design difficult and causes serious control system instabilities. At lower power settings, this fuel overheating is particularly troublesome because the low pressure in the combustion chamber results in fuel boiling at even lower temperatures.

As already suggested, carbon buildup is undesirable because it may interfere with heat transfer, but another problem resulting from carbon buildup is much more serious. Specifically, stored energy combustors are frequently used to produce hot gases for driving turbine wheels. As carbon builds up, particles thereof typically break free and then flow with the hot gases of combustion through the turbine wheel. Unfortunately, particulate carbon erodes the turbine nozzles and the turbine wheels. Furthermore, carbon deposits can build up on the surfaces of the turbine nozzles and restrict the flow to cause performance losses.

Still another problem associated with excessive carbon production is the existence of a massive black exhaust plume which is highly undesirable.

Presently, it is believed that a substantial portion of the carbon produced is a result of liquid phase pyrolysis during liquid fuel droplet evaporation. Some gas phase carbon probably also results from the cracking reactions. However, the gas phase carbon is on the molecular level and such less harmful than liquid phase carbon which is on the order of microns for purposes of comparison.

Since it is believed that the carbon is a result of liquid phase pyrolysis, it is essential to achieve rapid fuel evaporation. This is the best known manner of minimizing liquid phase carbon. However, stored energy combustors have not been entirely satisfactory in addressing these serious carbon problems.

While addressing all of the foregoing problems, it is also necessary to make it possible to achieve ignition without any substantial difficulty. This can be accomplished by enlarging the combustor to reduce velocity but this produces a problem in terms of over-sizing. As a result, any practical solution must take into account weight and space savings in the combustor, reduction in propellant consumption by enhanced cracking and consequent substantial reductions in carbon and smoke.

The present invention is directed to overcoming one or more of the foregoing problems and achieving one or more of the resulting objects.

SUMMARY OF THE INVENTION

It is the principal object of the invention to provide a new and improved stored energy combustor. More specifically, it is an object of the invention to provide a stored energy combustor that is constructed with a secondary stored energy zone whereby an interior wall fuel film is evaporated by interaction with hot gases of combustion. It is also an object of the invention to provide a stored energy combustor in which the hot gases of combustion interact with a cold liquid fuel film to thereby produce a cool gaseous fuel annulus in a stabilized stratification.

An exemplary embodiment of the invention achieves the foregoing in a stored energy combustor comprising a vessel having an interior wall defining narrow, spaced apart inlet and outlet ends interconnected by a relatively wide combustion chamber. The inlet end and combustion chamber comprise a primary stored energy zone and the outlet end comprises a secondary stored energy zone. The vessel also has means for igniting an oxidant and a fuel in the primary stored energy zone to produce hot gases of combustion, and an oxidant inlet port is provided upstream of the combustion chamber for directing oxidant into the combustion chamber and a fuel discharge port is provided upstream of the combustion chamber for directing fuel into the combustion chamber. The stored energy combustor also includes a fuel discharge port downstream of the combustion chamber for directing fuel into the secondary stored energy zone. In the exemplary embodiment, the fuel discharge port is arranged to direct fuel in a manner forming a fuel film on the interior wall in the secondary stored energy zone such that the hot gases of combustion interact with the fuel film to cause fuel evaporation in the secondary stored energy zone.

Preferably, the stored energy combustor includes means upstream of the combustion chamber and the upstream fuel discharge port for swirling the oxidant in the primary stored energy zone. The vessel also advantageously has an exterior wall in closely spaced relation to the interior wall to define an oxidant flow path therebetween which extends from the outlet end about the combustion chamber to the inlet end for communication with the oxidant inlet port. Additionally, the vessel preferably has a longitudinal axis extending from the inlet end through the combustion chamber to the outlet end thereof.

With this arrangement, the downstream fuel discharge port preferably includes a plurality of discrete fuel orifices in the interior wall of the vessel in the secondary stored energy zone. The fuel orifices are disposed at an angle so as to be generally tangential in a plane perpendicular to the longitudinal axis of the vessel. The fuel orifices are each in communication with an annular fuel supply ring in the interior wall concentric with the longitudinal axis of the vessel. Further, the annular fuel supply ring is preferably in communication with a source of fuel through a fuel supply tube in the interior wall of the vessel.

In an alternative embodiment, the downstream fuel discharge port includes an annular slot in the interior wall of the vessel in the secondary stored energy zone. The annular slot is preferably disposed at an angle so as to be generally tangential in the direction of the longitudinal axis toward the outlet end of the vessel. The annular slot is advantageously in communication with an annular fuel supply ring in the interior wall concentric with the longitudinal axis of the vessel. As with the prior embodiment, the annular fuel supply ring is preferably in communication with a source of fuel through a fuel supply tube in the interior wall of the vessel.

In a highly preferred embodiment, the combustion chamber is generally spherical and includes a pair of hemispherical liners loosely positioned within the combustion chamber. The inlet end and outlet end are then advantageously generally tubular extensions of the vessel leading to and from the combustion chamber. As previously suggested, the vessel may also have an exterior wall in closely spaced relation to the interior wall to define an oxidant flow path extending from the outlet end about the combustion chamber to the inlet end to provide cooling of the interior wall.

In this highly preferred embodiment, a cold liquid fuel is directed into the secondary stored energy zone by the downstream fuel discharge port. This in turn produces a cold liquid fuel film on the interior wall in the secondary stored energy zone which interacts with the hot gases of combustion to cause fuel evaporation. In this connection, the hot gases of combustion produce a cool gaseous fuel annulus thereabout adjacent the interior wall from evaporation of the cold liquid fuel film.

Other objects, advantages and features of the present invention will become apparent from a consideration of the following specification taken in conjunction with the accompanying drawings.

DETAILED DESCRIPTION OF THE PREFERRED EMBODIMENTS

Figures 1, 2, 3, 4:
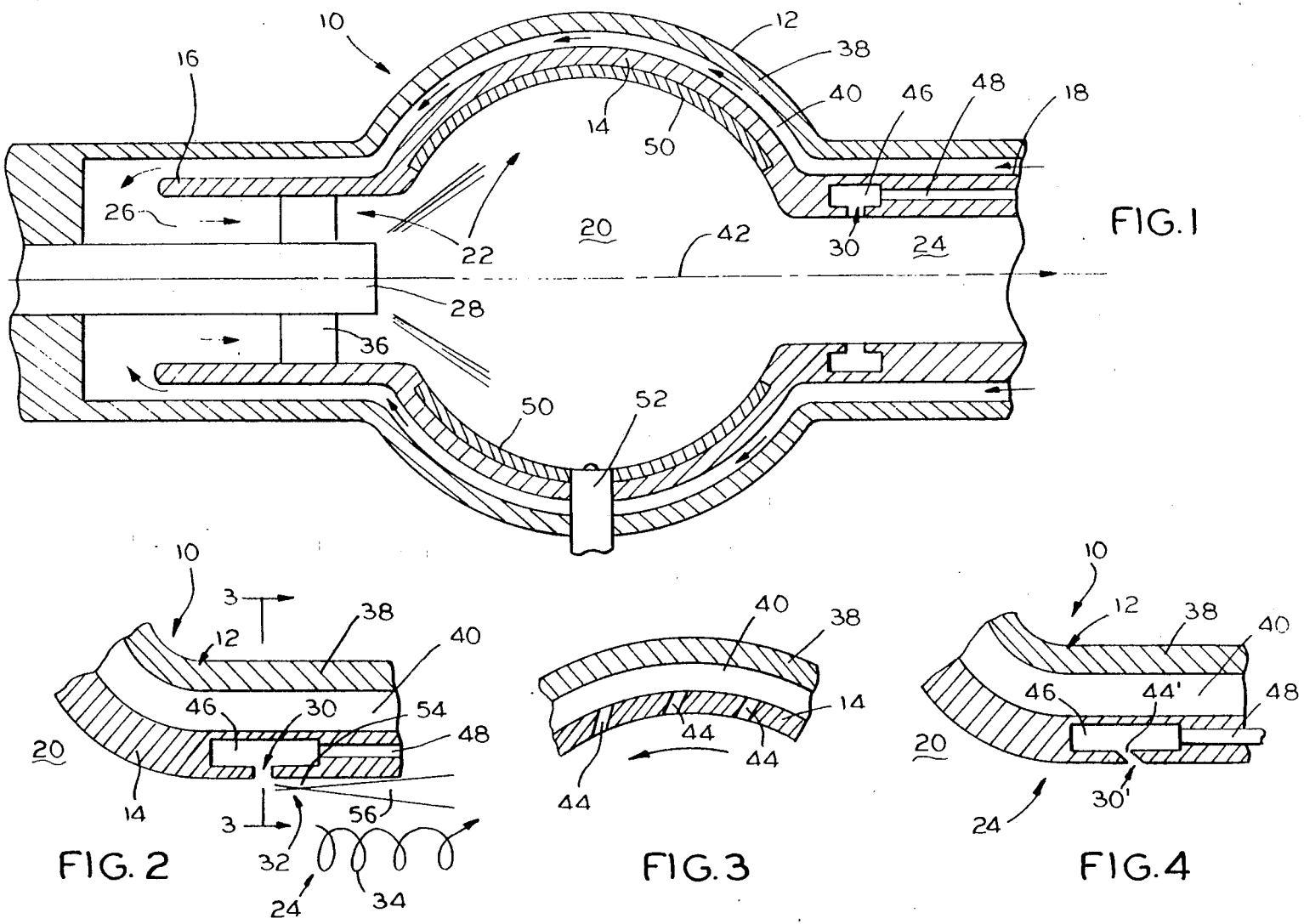
FIG. 1 is a partially schematic, partially sectional view of a stored combustor in accordance with the present invention.
FIG. 2 is an enlarged detail view of a portion of the stored energy combustor of FIG. 1.
FIG. 3 is a cross sectional view taken on the line 3—3 of FIG. 2.
FIG. 4 is an enlarged detail view showing an alternative embodiment of the stored energy combustor of the present invention.

In the illustrations given, and with reference first to FIG. 1, the reference numeral 10 designates generally a stored energy combustor in accordance with the present invention. The stored energy combustor 10 includes a vessel 12 having an interior wall 14 defining narrow spaced apart inlet and outlet ends 16 and 18 interconnected by a relatively wide combustion chamber 20. The inlet end 16 and combustion chamber 20 comprise a primary stored energy zone generally designated 22 and the outlet end 18 comprises a secondary stored energy zone generally designated 24. As for other aspects of the stored energy combustor 10, the vessel 12 also has means for igniting an oxidant and a fuel in the primary stored energy zone 22 to produce hot gases of combustion.

Still referring to FIG. 1, the stored energy combustor 10 includes an oxidant inlet port 26 upstream of the combustion chamber 20 for directing oxidant into the combustion chamber 20. It will also be seen that a fuel discharge port 28 is provided upstream of the combustion chamber 20 for directing fuel into the combustion chamber 20. Additionally, the stored energy combustor 10 includes a fuel discharge port 30 downstream of the combustion chamber 20 for directing fuel into the secondary stored energy zone 24.

Referring to FIG. 2, the downstream fuel discharge port 30 is arranged to direct fuel in a manner forming a fuel film as at 32 on the interior wall 14 in the secondary stored energy zone 24. The hot gases of combustion as represented by the arrow 34 can then interact with the fuel film 32 to cause fuel evaporation in the secondary stored energy zone 24. As will be appreciated by the helical arrow 34, means are provided upstream of the combustion chamber 20 and the upstream fuel discharge port 28 for swirling the oxidant in the primary stored energy zone 22.

More specifically, the oxidant swirling means preferably comprises air swirler blades 36. These air swirler blades 36 may be set at a desired angle to create the needed amount of oxidant swirl such that the swirl in the hot gases of combustion as at 34 achieves stabilized vaporization of the fuel film 32 as will be described in greater detail hereinafter. As for the exact air swirl angle, this will depend on the parameters for a given application.

Referring once again to FIG. 1, the vessel 12 also has an exterior wall 38 in closely spaced relation to the interior wall 14 to define an oxidant flow path 40 therebetween. The oxidant flow path 40 extends from the outlet end 18 about the combustion chamber 20 to the inlet end 16 for communication with the oxidant inlet port 26. As will be seen, the vessel 12 has a longitudinal axis 42 extending from the inlet end 16 through the combustion chamber to the outlet end 18 thereof.

With this arrangement, the downstream fuel discharge port 30 includes a plurality of discrete fuel orifices 44 (see FIG. 3) in the interior wall 14 of the vessel 12 in the secondary stored energy zone 24. The fuel orifices 44 are disposed at an angle so as to be generally tangential in a plane perpendicular to the longitudinal axis 42 of the vessel 12. The fuel orifices 44 are each also in communication with an annular fuel supply ring 46 in the interior wall 14 concentric with the longitudinal axis 42 of the vessel 12. In this manner, and as shown in FIG. 3, the fuel orifices 44 inject fuel in the same direction as swirl for best results. Still further, the annular fuel supply ring 46 is suitably in communication with a source of fuel through a fuel supply tube 48 within the interior wall 14 of the vessel 12.

Alternatively, as shown in FIG. 4, the downstream fuel discharge port 30' may include an annular slot 44' in the interior wall 14 of the vessel 12 in the secondary stored energy zone 24. The annular slot 44' is disposed at an angle so as to be generally tangential in the direction of the longitudinal axis 42 toward the outlet end 18 of the vessel 12. The annular slot 44' is also in communication with an annular fuel supply ring 46 in the interior wall 14 concentric with the longitudinal axis 42 of the vessel 12. Additionally, the annular fuel supply ring 46 may suitably be in communication with a source of fuel through a fuel supply tube 48 within the interior wall 14 of the vessel 12.

Referring once again to FIG. 1, it will be seen that the combustion chamber 20 is generally spherical and includes a pair of hemispherical liners 50 loosely positioned within the combustion chamber 20. These and other details may all be in accordance with commonly owned and copending patent applications Ser. No. 123,303, filed Nov. 20, 1987; Ser. No. 272,409, filed Nov. 17, 1988; and Ser. No. 324,806 filed Mar. 17, 1989. As will also be seen, the inlet end 16 and outlet end 18 are generally tubular extensions of the vessel 12, i.e., the interior wall 14, which lead to and from the combustion chamber 20 about the longitudinal axis 42.

As shown in FIG. 1, the oxidant flow path 40 extends from the outlet end 18 about the combustion chamber 20 to the inlet end 16 to provide cooling of the interior wall 4. It will also be seen and appreciated that the oxidant inlet port 26 is concentric with the longitudinal axis 42 of the vessel 12 at the inlet end 16 and the upstream fuel discharge port 28 is likewise concentric with the longitudinal axis 42 of the vessel 12 at or just upstream of the combustion chamber 20. In this connection, the fuel discharge port 28 upstream of the combustion chamber 20 is adapted for directing a cold liquid fuel into the combustion chamber 20.

With this understanding, the air swirler blades 36 are disposed upstream of the combustion chamber 20 for swirling the oxidant as previously mentioned. This is done to produce mixing of the oxidant and the cold liquid fuel for ignition by means of the igniter 52 which, as shown, passes through the exterior wall 38 and the interior wall 14 as well as one of the hemispherical liners 50 so as to be exposed within the combustion chamber 20. With this arrangement, the cold liquid fuel and oxidant mixture may be ignited and the swirling oxidant will cause swirling of the resulting hot gases of combustion produced thereby.

As previously suggested, the fuel discharge port 30 downstream of the combustion chamber 20 is adapted to direct the cold liquid fuel into the secondary stored energy zone 24. This is done in a manner forming a cold liquid fuel film as at 54 directly on the cooled interior wall 14 in the secondary stored energy zone 24, and the hot gases of combustion as represented by the arrow 34 interact with the cold liquid fuel film 54. Because of this interaction, fuel evaporation occurs in the secondary stored energy zone 24 which in turn produces a cool gaseous fuel annulus as at 56 thereabout adjacent the interior wall 14.

From the foregoing, it should now be appreciated that the evaporation of the cold fuel film serves as an excellent coolant. This is achieved even though immediately adjacent there are very high gas temperatures, e.g., as high as 3800° F. Because of the gravity or "G" force effects, the cool evaporated fuel tends to be maintained at or near the surface of the interior wall.

Moreover, it is known to be important to evaporate the cold fuel film in a manner which avoids boiling of the fuel. This is facilitated by the cooling effects of the annular fuel supply ring on the interior wall 14 in the region of the secondary stored energy zone and by the cooling effect of the cold fuel film 54 and the immediately adjacent relatively cool gaseous fuel annulus 56. Supplementary cooling of the interior wall 14 at the outlet end 18 is also facilitated by oxidant cooling and/or enhancement by trip strips or the like as shown in FIG. 2.

While in the foregoing there have been set forth preferred embodiments of the invention, it will be appreciated that the details herein given may be varied by those skilled in the art without departing from the true spirit and scope of the appended claims.

I claim:

1. A stored energy combustor, comprising:

a vessel having an interior wall defining narrow, spaced apart inlet and outlet ends interconnected by a relatively wide combustion chamber, said inlet end and combustion chamber comprising a primary stored energy zone and said outlet end comprising a secondary stored energy zone of substantially uniform diameter, said vessel also having means for igniting an oxidant and a fuel in said primary stored energy zone to produce hot gasses of combustion;

an oxidant inlet port upstream of said combustion chamber for directing oxidant into said combustion chamber;

a fuel discharge port upstream of said combustion chamber for directing fuel into said combustion chamber; and a fuel discharge port downstream of said combustion chamber for directing fuel into said secondary stored energy zone, said fuel discharge port being arranged to direct fuel in a manner forming a fuel film on said interior wall in said secondary stored energy zone such that said hot gasses of combustion interact with said fuel film to cause said fuel film to evaporate in said secondary stored energy zone, said evaporating fuel film producing a stabilized stratification comprising a cool gaseous fuel annulus between said hot gases of combustion and said interior wall in said secondary stored energy zone.

2. The stored energy combustor of claim 1 including means upstream of said combustion chamber and said upstream fuel discharge port for swirling said oxidant in said primary stored energy zone.

3. The stored energy combustor of claim 1 wherein said vessel also has an exterior wall in closely spaced relation to said interior wall to define an oxidant flow path therebetween.

4. The stored energy combustor of claim 3 wherein said oxidant flow path extends from said outlet end about said combustion chamber to said inlet end for communication with said oxidant inlet port.

5. The stored energy combustor of claim 1 wherein said vessel has a longitudinal axis extending from said inlet end through said combustion chamber to said outlet end thereof.

6. The stored energy combustor of claim 5 wherein said downstream fuel discharge port includes a plurality of discrete fuel orifices in said interior wall of said vessel in said secondary stored energy zone.

7. The stored energy combustor of claim 6 wherein said fuel orifices are disposed at an angle so as to be generally tangential in a plane perpendicular to said longitudinal axis of said vessel.

8. The stored energy combustor of claim 7 wherein each of said fuel orifices is in communication with an annular fuel supply ring in said interior wall concentric with said longitudinal axis of said vessel.

9. The stored energy combustor of claim 8 wherein said annular fuel supply ring is in communication with a source of fuel through a fuel supply tube in said interior wall of said vessel.

10. The stored energy combustor of claim 5 wherein said downstream fuel discharge port includes an annular slot in said interior wall of said vessel in said secondary stored energy zone.

11. The stored energy combustor of claim 10 wherein said annular slot is disposed at an angle so as to be generally tangential in the direction of said longitudinal axis toward said outlet end of said vessel.

12. The stored energy combustor of claim 11 wherein said annular slot is in communication with an annular fuel supply ring in said interior wall concentric with said longitudinal axis of said vessel.

13. The stored energy combustor of claim 12 wherein said annular fuel supply ring is in communication with a source of fuel through a fuel supply tube in said interior wall of said vessel.

14. A stored energy combustor, comprising:

a vessel having an interior wall defining narrow, spaced apart inlet and outlet ends interconnected by a relatively wide combustion chamber, said inlet end and combustion chamber comprising a primary stored energy zone and said outlet end comprising a secondary stored energy zone of substantially uniform diameter, said vessel also having means for igniting an oxidant and a fuel in said primary stored energy zone to produce hot gasses of combustion;

said vessel having a longitudinal axis extending from said inlet end through said combustion chamber to said outlet end thereof, said combustion chamber being generally spherical and including a pair of hemispherical liners loosely positioned within said combustion chamber, said inlet end and outlet end being generally tubular extensions of said vessel leading to and from said combustion chamber;

an oxidant inlet port upstream of said combustion chamber for directing oxidant into said combustion chamber, said oxidant inlet port being concentric with said longitudinal axis of said vessel at said inlet end;

a fuel discharge port upstream of said combustion chamber for directing fuel into said combustion chamber, said upstream fuel discharge port being concentric with said longitudinal axis of said vessel at said combustion chamber;

means upstream of said combustion chamber for swirling said oxidant to produce mixing of oxidant and fuel for ignition in said combustion chamber along with swirling of said hot gasses of combustion produced thereby; and a fuel discharge port downstream of said combustion chamber for directing fuel into said secondary stored energy zone, said fuel discharge port being arranged to direct fuel in a manner forming a fuel film on said interior wall in said secondary stored energy such that said hot gasses of combustion interact with said fuel film to cause said fuel film to evaporate in said secondary stored energy zone, said evaporating fuel film producing a stabilized stratification comprising a cool gaseous fuel annulus between said hot gases of combustion and said interior wall in said secondary stored energy zone.

15. The stored energy combustor of claim 14 wherein said vessel also has an exterior wall in closely spaced relation to said interior wall to define an oxidant flow path therebetween.

16. The stored energy combustor of claim 15 wherein said oxidant flow path extends from said outlet end about said combustion chamber to said inlet end for communication with said oxidant inlet port.

17. The stored energy combustor of claim 14 wherein said downstream fuel discharge port includes a plurality of discrete fuel orifices in said interior wall of said vessel in said secondary stored energy zone.

18. The stored energy combustor of claim 17 wherein said fuel orifices are disposed at an angle so as to be generally tangential in a plane perpendicular to said longitudinal axis of said vessel.

19. The stored energy combustor of claim 18 wherein each of said fuel orifices is in communication with an annular fuel supply ring in said interior wall concentric with said longitudinal axis of said vessel.

20. The stored energy combustor of claim 19 wherein said annular fuel supply ring is in communication with a source of fuel through a supply tube in said interior wall of said vessel.

21. The stored energy combustor of claim 14 wherein said downstream fuel discharge port includes an annular slot in said interior wall of said vessel in said secondary stored energy zone.

22. The stored energy combustor of claim 21 wherein said annular slot is disposed at an angle so as to be generally tangential in the direction of said longitudinal axis toward said outlet end of said vessel.

23. The stored energy combustor of claim 22 wherein said annular slot is in communication with an annular fuel supply ring in said interior wall concentric with said longitudinal axis of said vessel.

24. The stored energy combustor of claim 23 wherein said annular fuel supply ring is in communication with a source of fuel through a fuel supply tube in said interior wall of said vessel.

25. A stored energy combustor, comprising:

a vessel having an interior wall defining narrow, spaced apart inlet and outlet ends interconnected by a relatively wide combustion chamber, said inlet end and combustion chamber comprising a primary stored energy zone and said outlet end comprising a secondary stored energy zone of substantially uniform diameter, said vessel also having means for igniting an oxidant and a fuel in said primary stored energy zone to produce hot gasses of combustion;

said vessel having a longitudinal axis extending from said inlet end through said combustion chamber to said outlet end thereof, said combustion chamber being generally spherical and including a pair of hemispherical liners loosely positioned within said combustion chamber, said inlet end and outlet end being generally tubular extensions of said vessel leading to and from said combustion chamber;

said vessel also having an exterior wall in closely spaced relation to said interior wall to define an oxidant flow path therebetween, said oxidant flow path extending from said outlet end about said combustion chamber to said inlet end to provide cooling of said interior wall;

an oxidant inlet port upstream of said combustion chamber for directing an oxidant from said flow path into said combustion chamber, said oxidant inlet port being concentric with said longitudinal axis of said vessel at said inlet end;

a fuel discharge port upstream of said combustion chamber for directing a cold liquid fuel into said combustion chamber, said upstream fuel discharge port being concentric with said longitudinal axis of said vessel at said combustion chamber;

means upstream of said combustion chamber for swirling said oxidant to produce mixing of said oxidant and said cold liquid fuel for ignition in said combustion chamber along with swirling of hot gasses of combustion produced thereby; and a fuel discharge port downstream of said combustion chamber for directing said cold liquid fuel into said secondary stored energy zone, said fuel discharge port being arranged to direct fuel in a manner forming a cold liquid fuel film on aid interior wall in said secondary stored energy zone such that said hot gasses of combustion interact with said cold liquid fuel film to cause said fuel film to evaporate in said secondary stored energy zone, said evaporating fuel film producing a stabilized stratification comprising a cool gaseous fuel annulus between said hot gases of combustion and said interior wall in said secondary stored energy zone.

26. The stored energy combustor of claim 25 wherein said downstream fuel discharge port includes a plurality of discrete fuel orifices in said interior wall of said vessel in said secondary stored energy zone, each of said fuel orifices being disposed at an angle so as to be generally tangential in a plane perpendicular to said longitudinal axis of said vessel, each of said fuel orifices also being in communication with an annular fuel supply ring in said interior wall concentric with said longitudinal axis of said vessel, said annular fuel supply ring producing cooling of said interior wall about said fuel orifices.

27. The stored energy combustor of claim 25 wherein said downstream fuel discharge port includes an annular slot in said interior wall of said vessel in said secondary stored energy zone, said annular slot being disposed at an angle so as to be generally tangential in the direction of said longitudinal axis toward said outlet end of said vessel, said annular slot being in communication with an annular fuel supply ring in said interior wall concentric with said longitudinal axis of said vessel, said annular fuel supply ring producing cooling of said interior wall about said annular slot.

* * * * *